US005377931A

United States Patent [19]

Dörfel et al.

[11] Patent Number: 5,377,931

[45] Date of Patent: Jan. 3, 1995

[54] APPARATUS FOR REELING A WOUND WEB REEL

[75] Inventors: Gerhard W. Dörfel, Boll; Jürgen Treutner, Ostfildern, both of Germany

[73] Assignee: Beloit Technologies, Inc., Wilmington, Del.

[21] Appl. No.: 949,647

[22] PCT Filed: Aug. 28, 1990

[86] PCT No.: PCT/EP90/01430

§ 371 Date: Dec. 4, 1992

§ 102(e) Date: Dec. 4, 1992

[87] PCT Pub. No.: WO91/18813

PCT Pub. Date: Dec. 12, 1991

[30] Foreign Application Priority Data

Jun. 8, 1990 [DE] Germany ..... 4018314

[51] Int. Cl.[6] ..... B65H 18/10; B65H 18/16

[52] U.S. Cl. ..... 242/530; 242/542.3; 242/547

[58] Field of Search ..... 242/56.2, 56.4, 56.5, 242/56.6, 65, 530, 530.4, 541.1, 541.4, 542.3, 547

[56] References Cited

U.S. PATENT DOCUMENTS

| | | | |
|---|---|---|---|
| 3,350,026 | 10/1967 | Amos | 242/65 |
| 3,378,213 | 4/1968 | Habozit | 242/65 |
| 3,433,429 | 3/1969 | Schnitzspahn | 242/65 |
| 4,634,069 | 1/1987 | Katoaka | 242/65 |
| 5,320,297 | 6/1994 | Goerner et al. . | |

FOREIGN PATENT DOCUMENTS

| | | |
|---|---|---|
| 324707 | 7/1989 | European Pat. Off. . |
| 365912 | 5/1990 | European Pat. Off. . |

*Primary Examiner*—John M. Jillions

*Attorney, Agent, or Firm*—Dirk J. Veneman; Raymond W. Campbell; Gerald A. Mathews

[57] ABSTRACT

A drive arrangement for apparatus for reeling a traveling web into a reel includes a pair of spaced, parallel guides for supporting a tube on which the web is to be wound. The guides are mounted on pivotable arms and the tubes are rotatably supported in a carriage at either end, which carriages are adapted to traverse the guides as the diameter of the wound web reel grows. A looped, motor-driven belt is disposed over a drive wheel on the carriage to provide torque to the tube continuously from when the tube is initially nipped with a backing roll to when the wound web reel is finished. The carriages are moved along the guides by a motor driven traction mechanism, such as a looped chain which is attached to the carriages.

7 Claims, 5 Drawing Sheets

APPARATUS FOR REELING A WOUND WEB REEL

BACKGROUND OF THE INVENTION

1. Field of the Invention

The invention relates to a reeling device for reeling (i.e. winding) a traveling web onto a tube, or core, and into a plurality of reels, or wound web rolls. More particularly, this invention relates to a reeling device where the tube is supported at each end in a carriage laterally movable on a pair of spaced, parallel, substantially horizontally disposed guides, or rails. The carriage and rails are, in turn, mounted on a support structure which is pivotable such as to bring a tube and the web roll wound thereon selectively into and out of nipping engagement with a backing roll, which is substantially horizontally mounted relative to the tube. Still more particularly, this invention relates to a drive apparatus which utilizes a looped belt for engaging a wheel-like drive for the tube to provide torque drive to the tube continuously as the diameter of the reel increases and the reel is moved along the rails while maintaining nipping engagement with the backing roll.

2. Description of the Prior Art

Such reeling devices are used with reel-cutting machines especially. Whereas, with reel-cutting machines of the transportation roller type, where the reel to be reeled rests with its own weight on one or two rotating transporting rollers, so that the dead weight of the reel to be reeled ensures that the contact pressure necessary for the slip-free transmission of torque from the transportation roller(s) to the reel to be reeled is sufficient, care must be taken with reel-cutting machines of the backing roll type—regardless of whether only the backing roll, or the backing roll and the winding tubes of the reels to be reeled, are driven in the direction of rotation—to ensure that there is sufficient contact pressure between the reel to be reeled and the backing roll.

To do this, two methods are known: First, either the supporting arms or the supporting structures are pivotably secured so that the pivoting movement of these supporting arms or supporting structure follows the change in diameter of the reel during the reeling process. In this case, the supporting arms or supporting structure are swiveled by means of a hydraulic cylinder each, it being possible for the contact pressure to be applied to the backing roll by way of the hydraulic cylinder. The other possibility of applying the contact pressure consists of maintaining the supporting arms or supporting structures in the same position throughout the whole reeling cycle and arranging the clamping head for the winding tubes of the reels to be reeled on one carriage each, which carriage can move towards or away from the backing roll in a guide fitted to the supporting arm or the supporting structure, and applying a (contact) pressure that acts in the direction of the backing roll using a lever arm and a hydraulic cylinder that pivots the lever arm.

Although the reeling devices according to the generic section can be used in many different types of machines, particularly substantial advantages can be gained from their use in reel-cutting machines of the backing roll type. In the case of these reel-cutting machines, the tubes or roll, on which the part-webs produced by lengthwise cutting are reeled, laterally abut one or two backing rolls that are arranged parallel to one another, preferably adjacent to one another. Due to the necessary space required in the direction of the axis of the backing roll for the supporting arms of the backing rolls, the part-webs immediately adjacent to one another are reeled on opposite sides, respectively, as regards the backing rolls. With such reel-cutting machines, the ability to also reel reels with the smallest possible web width is desirable. Therefore, if several reeling devices are provided on at least one of the sides of the backing rolls (i.e. several part-web reels are to be reeled), there is very little space available for the supporting arms or supporting structures at times. This requirement can be met relatively simply, if the rotating drive for the reeling process is effected by driving the backing rolls and the drive torque transmitted friction-tight to the reel to be reeled pressed lightly against the backing roll.

On the other hand, those arrangements where each clamping head has its own rotating drive take up more space, i.e. the torque acts in the center of the reel to be reeled (center winding). In such cases, in order to achieve the smallest possible width of the supporting arms or supporting structures (looking in the direction of the backing roll axis), either hydraulic motors or electric motors are fitted such that their drive shafts are at right angles to the reeling shaft. In this way, the overall length of the drive motors looking in the direction of the axis can be comparatively large without the supporting arms or supporting structures becoming excessively long. The use is specially recommended of the motor housing of an electric motor as part of the supporting arm. Such apparatus is shown in DE 38 00 703 A1. This known arrangement, therefore, takes into account an angular gear between the motor shaft and the reeling shaft axis.

SUMMARY OF THE INVENTION

The invention relates to both aforementioned possibilities of allowing the reeling shaft to follow the change in diameter during the reeling process.

The space requirement for the reel drive unit can be particularly effectively reduced by using a motor in conjunction with a concentric, annular drive element, such as a wheel.

An especially preferred further development of the invention is the ability to provide a center drive for the tubes at all times during the reeling process. Although it is known—and previously described, that the supporting arms or supporting structures can maintain their position during the reeling process and that the clamping heads can be arranged so that they can move or be displaced according to the change in the reel diameter by means of guides on the supporting arms, or supporting structures, it has not been previously possible, using these known arrangements, to create a center drive because this would have led to an unacceptably large width (looking in the direction of the backing roll axis) of the reeling mechanism. With this type of supporting structure, which are also known as reeling structures, it would not have been possible either to arrange the axis of the drive motor at right angles to the reeling shaft axis because this would have led to a disproportionately high design cost due to the maneuverability of the clamping head along a generally straight guide.

This disadvantage is rectified by the invention so that reeling mechanism can now also be fitted with the aforementioned reeling structures in the form of genuine center winders. It is possible in particular to essentially retain the system dimensions for known reeling structures so that, if required, there is even the possibility of re-fitting with the reeling drive units according to the invention. Even using this embodiment, it is, as desired, possible to create the same circumstances in relation to length and wrap angle of the belt according to the invention in each position of the clamping head as regards its guiding on the supporting arm/supporting structure. This is achieved particularly advantageously.

In order now to be able to control the movement or displacement of the carriage carrying the reel to be reeled during the reeling process, and/or to generate or to maintain a given linear pressure between the reel to be reeled and the backing roll assigned to it during the reeling process, a driven endless belt or chain disposed on a pivoted support structure, or arm, and looped over a drive wheel mounted concentric with a tube supported on the carriage is recommended. This can also be used to great advantage independently of the reel drive unit according to the invention and also regardless of whether there is center winding or whether only the backing roll is driven.

In the sense of the invention "supporting arms" or "supporting structure" means, any type of support element that is suitable for carrying the reel to be reeled during the reeling process, that the reel to be reeled is rotatably and, preferably, abuts the backing roll assigned to it. Such supporting arms or supporting structures preferably have a facility for subsequently depositing the finished reeled roll on the ground or a means of transport. Such supporting arms or supporting structures are widely known in reeling devices and need not, therefore, be described in more detail.

In the sense of the invention, "belt" and "chain" are any elongated means of transmission that can be returned along its longitudinal direction in one, preferably single, direction and, if required, in the correspondingly opposite direction (180°) around appropriately shaped return devices. Between the driven wheel and the drive wheel of the reel drive unit, according to the invention, a means of transmission that transmits the rotating movement is, therefore, provided. Provided the drive wheel is not arranged on a movable or displaceable carriage, the means of transmission can, under certain circumstances, also be a wheel work, such as a toothed gear.

In the sense of the invention, "revolvably arranged traction mechanisms" are means of transmission that are effective under tension for driving forces that can be returned by return devices such that they can act on the carriage in essentially opposing directions. For this purpose, also the aforementioned means of transmission, such as belts or chains, can be used by which are meant—as with means of transmission as well—by belt, both flat, toothed or V-shaped belts or similar belts, as well as any type of cable and similar elements that are capable of bearing loads when under tension.

The aforementioned structural parts to be used, according to the invention, are not, as regards their size, shape, selection of material and technical design, subject to any particular exceptions, which means that the selection criteria known in the respective area of application can be used without restriction.

On this basis, the object of the invention is to create an improved center drive for the reeling shaft for reeling devices with the generic features previously mentioned, particularly for reel-cutting machines of the backing roll type.

This object is achieved by a reeling device such that 1) the space requirement looking in the direction of the backing roll axis for the reel drive unit is extraordinarily small; and 2) at the same time, a discretionary reduction or transmission of the motor speed to the clamping head is achieved.

The space requirement for the reel drive unit can be particularly effectively reduced by using a motor in conjunction with a concentric, annular drive element, such as a wheel or sheave, engaging the tube.

Further details, features and advantages of the object of the invention will emerge from the description which follows and from the relevant drawing, in which, by way of example, preferred embodiments of reeling devices according to the invention are shown.

DESCRIPTION OF THE PREFERRED EMBODIMENTS

Figure 1:
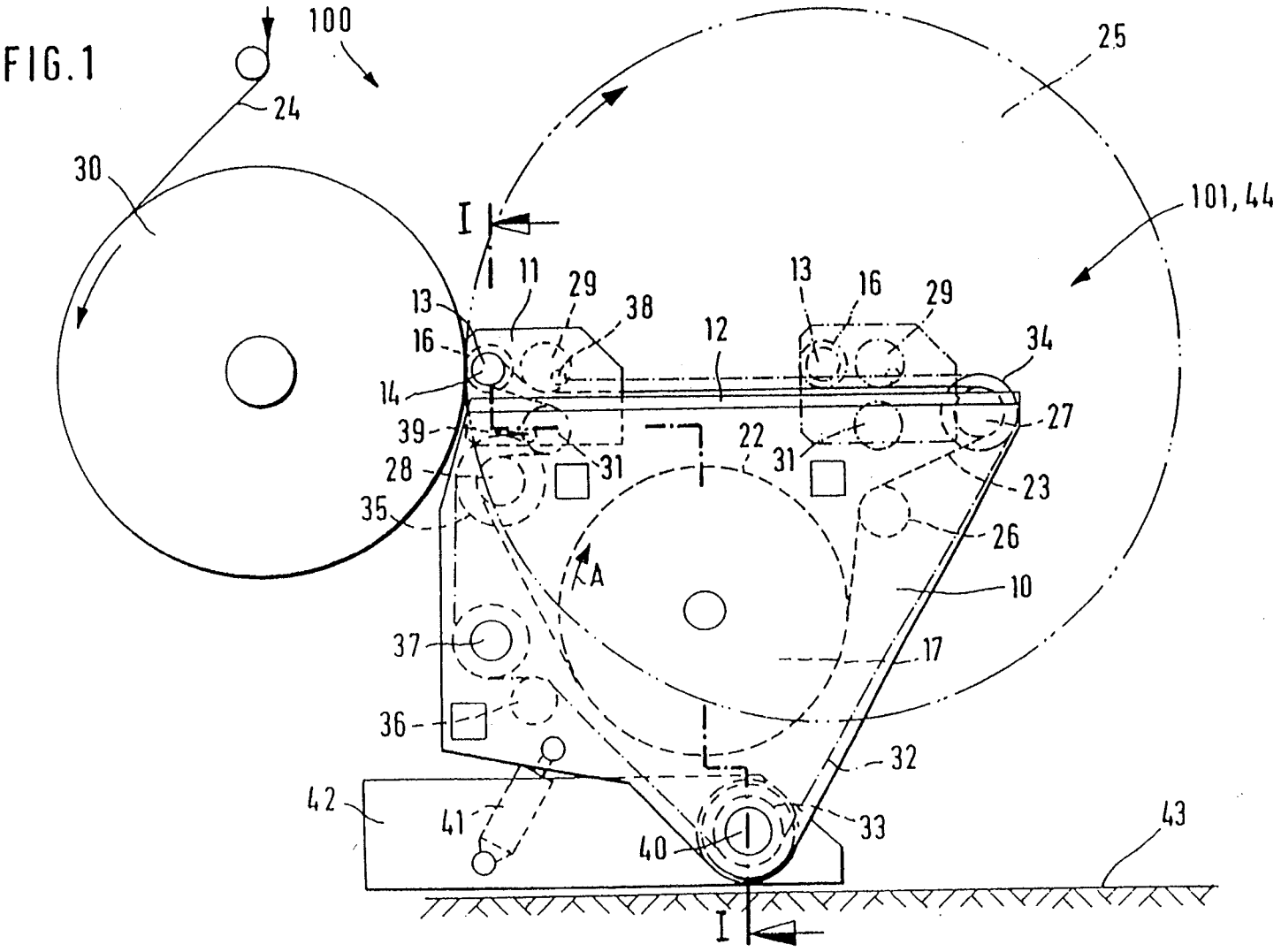
FIG. 1 is a side-elevational view of a reeling device for a reel-cutting machine, somewhat schematically represented, showing a support carriage for a reel to be reeled in both its extreme positions.
Figure 2:
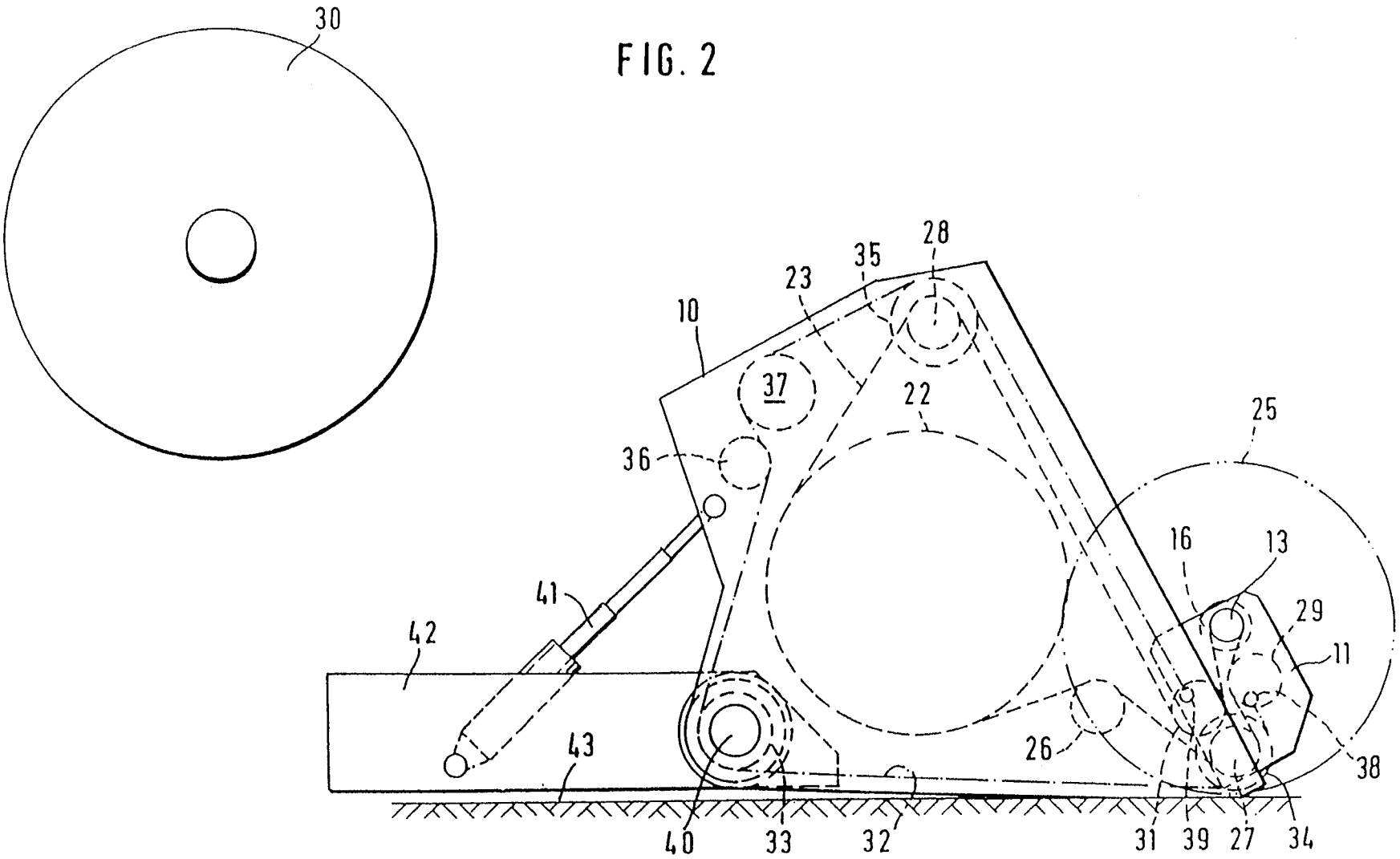
FIG. 2 is a side-elevational view of the same reeling device, but showing the apparatus in the reel deposit position (unloading position).
Figure 3:
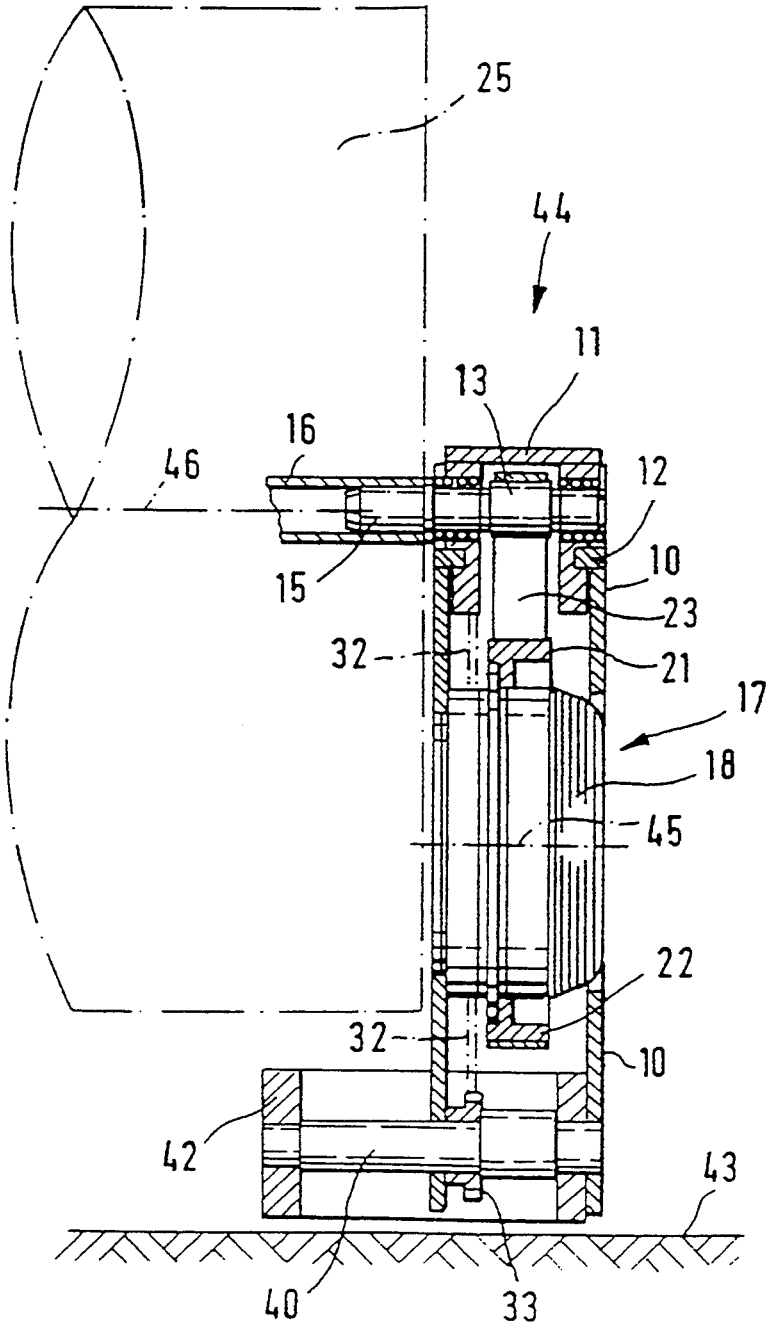
FIG. 3 is a side-elevational view of the same reeling device in section along the line 1—1 in FIG. 1.

The reeling device shown in FIGS. 1 to 3 as a complete unit, with the reference 100, shows the one side of a single reeling mechanism 101 and a backing roll 30. This backing roll can form part of a reel-cutting machine of the backing roll type, that is known and not shown separately in the drawing, on which a wide web of paper, or similar web material, is reeled off from a wide reel in a reeling station. The wide web is divided lengthwise (i.e. slit) into at least two narrow part-webs in a cutting station, the narrower part-webs being reeled in two reeling stations arranged on either side of the backing roll 30, or of several, in particular two, backing rolls and comprising, respectively, one reeling mechanism 101 at least.

A known, so-called reeling, structure serves as the supporting structure 10, which might be referred to as arms, of the reeling mechanism 101 on which supporting structure a carriage 11 is arranged that can move in straight guides, or rails, 12. The carriage 11 carries a rotatably arranged drive wheel 13 that, for example, takes the form of a V-shaped belt pulley, and which is offset to the carriage on the side of the carriage 11 opposite to the reel 25. A drive shaft 14, rotatably arranged, passes through the carriage 11 and carries on the side of the carriage 11 facing the reel 25 a clamping head 15, which is also known as a core chuck, (see FIG. 3), which can be clamped co-axially with the reel shaft 46 in known fashion friction-tight or form-fitting in the open end of a winding tube 16, which is also known as a core, for the reel 25 (i.e. a wound web roll) to be reeled.

Figure 5:
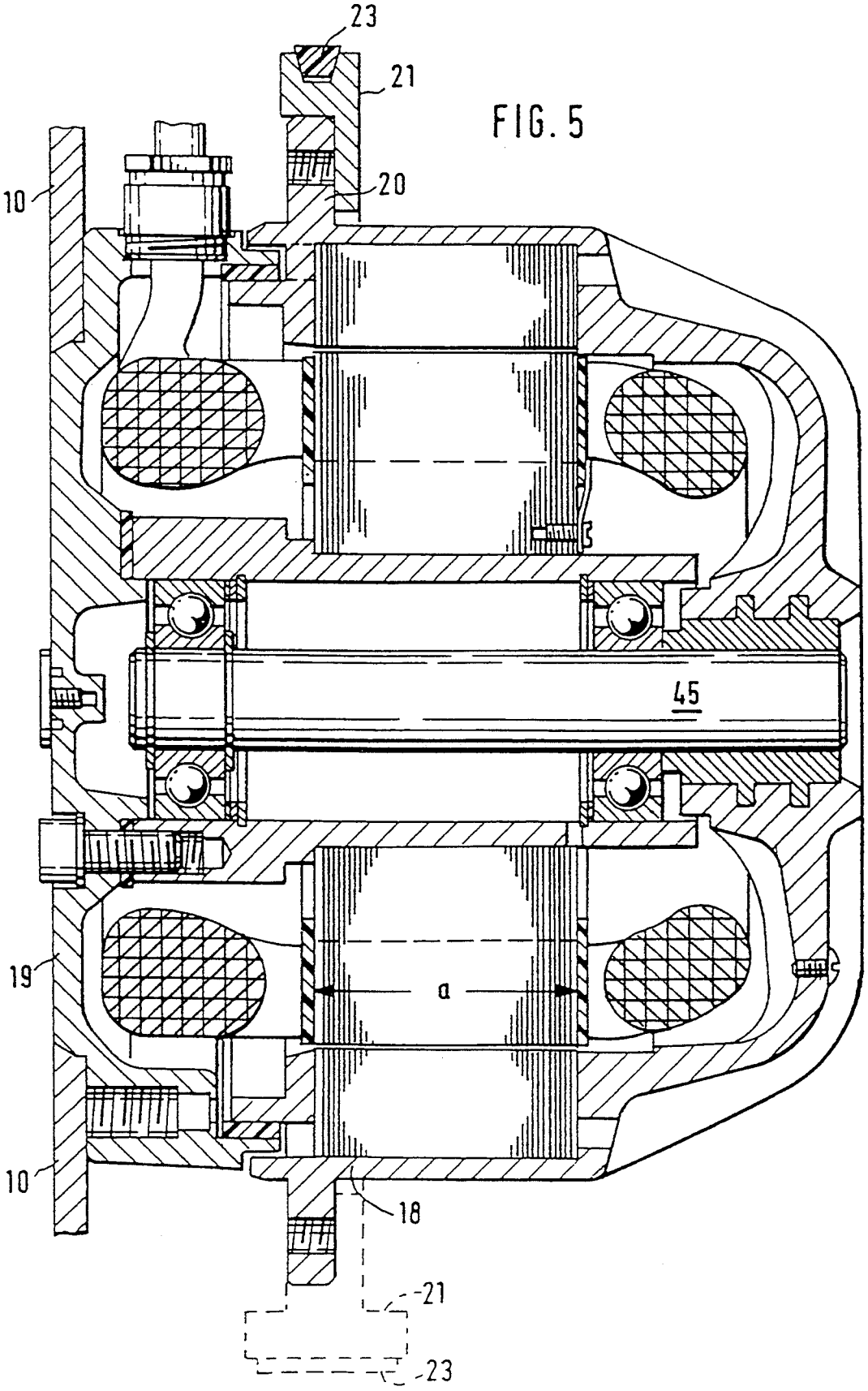
FIG. 5 is a cross-sectional view of a known three-phase external rotor motor in axial section suitable for use as a drive motor according to the invention.

The reeling structure 10 also carries a drive motor 17 which is a three-phase, or a direct current disc armature, outer rotor motor in accordance with FIG. 5 in all example embodiments shown. In the case of this drive motor, the rotor representing a rotatable, active driving member 18, which is attached to drive shaft 45 and functions as the outer rotor of the drive motor, rotates around a stator 19 secured to the supporting structure 10. With this example embodiment, the outer diameter of the rotatable, active driving member is as large as the largest outer diameter of the whole motor. The rotor (driving member 18) has on its outer circumference a bracket, for example a wrap-around flange 20, to which is secured an annular element 21 which, together with the driving member 18, forms a driven wheel 22 that can be used as a V-shaped belt pulley. The driven wheel 22 of the drive motor 17 and the drive wheel 13 on the carriage 11 lie in the same plane and around which wheel is wound a revolving drive belt 23 as a means of a transmission element, which belt in the embodiment of this example takes the form of a V-shaped belt. A clamping wheel 26 (i.e. an idler sheave or pulley) that can be moved with its shaft on the supporting structure 10 ensures that the drive belt 23 is sufficiently tensioned. At the height of the two ends of the guide 12 are provided on the supporting structure 10 return elements 27 and 28 in the form of rotatably arranged rollers that are also designed as V-shaped belt pulleys and which also lie in the same plane as the drive wheel and the driven wheel. In this way, the reeling drive unit can work in any position of the carriage 11 along the guide 12. Further return elements 29 and 31 in the form of rotatably arranged rollers on the carriage 11 or V-shaped belt pulleys enable the length of the drive belt 23 to be kept constant in any working position of the carriage 11, the wrap angle of the drive belt 23 around the drive wheel 13 also remaining unchanged.

The function of the reeling drive unit is now such that the reeling process starts with the carriage 11 in the position shown by unbroken lines in FIG. 1 on the left, in which process the start of the part-web 24 to be reeled is secured by wrapping it around and/or gluing (or similar) it to the winding tube 16, and the winding tube abuts (i.e. nips) the backing roll 30. By driving the drive wheel 13 in the direction of arrow A, the part-web 24 is now reeled up, the diameter of the already reeled-up reel 25 increasing constantly, so that the carriage 11 must be displaced to the right according to the increase in diameter (in the drawing), until it reaches the final position shown by broken lines. In this final position, the reel 25 has achieved its required final diameter.

The carriage is displaced by means of return devices 33 to 35 in the form of rotatable rolls (i.e. idler sheaves or rollers) or toothed wheels and a traction device 32 in the form of a cable, chain, or the like, which device acts on the carriage 11 in the direction of traction with its one end above the guide 12 at a fixing point 38 (i.e. attachment) of the carriage 11 and with its other end at a fixing point 39 of the carriage 11, which fixing point is arranged below the guide 12. The tilting moment exercised on the guide in both directions of operation remains constant due to the two fixing points 38 and 39 arranged on both sides of the guide 12.

For driving the traction device 32, a drive motor 37 is provided and for tensioning the chain, a clamping wheel 36. With this drive arrangement, the carriage 11 can not only be moved or displaced precisely and, in particular, in conjunction with the increase in the diameter of the reel 25, but it is also possible to generate and maintain in the respective carriage position the desired contact pressure of the reel 25 on the backing roll 30. The return devices 33 to 35 are advantageously arranged co-axially to the other shafts on the supporting structure 10.

In order to be able to move the whole supporting structure between the reeling position shown in FIG. 1 and between the unloading position shown in FIG. 2, the whole supporting structure 10 is, as known, pivotably arranged around a swivel pin 40 and can be pivoted between these two positions by means of a piston/cylinder arrangement 41.

Figure 4:
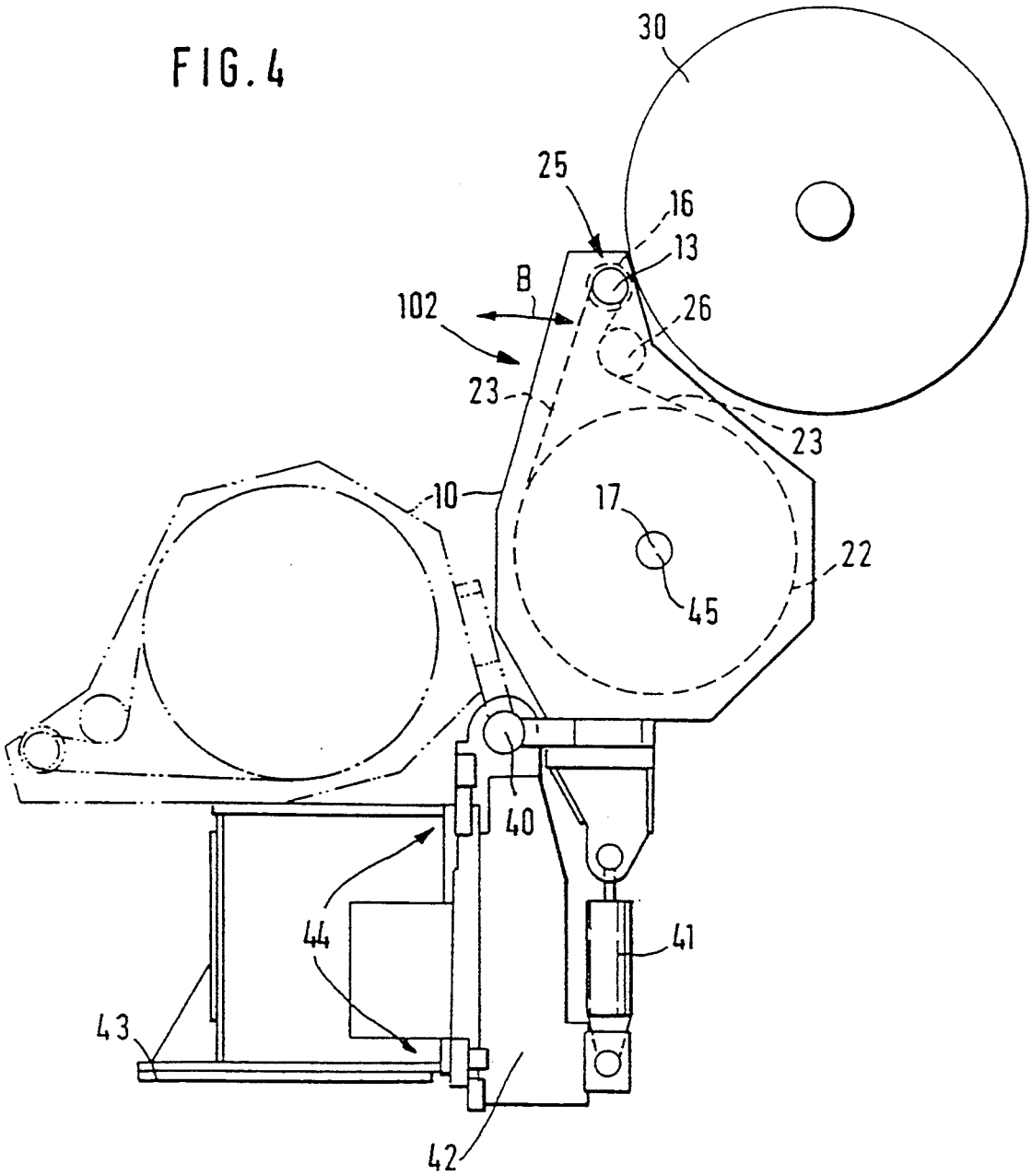
FIG. 4 is a side-elevational view of an alternative embodiment of a reeling device, looking in the direction of the axis of the backing roll, as in FIG. 1, showing both the reeling position (continuous lines), as well as the deposit position (broken lines).

In the case of the alternative embodiment 102 in accordance with FIG. 4, the position of the supporting arm or supporting structure 10 changes according to the increase in the diameter of the reel 25 to be reeled. To do this, the supporting arm or the supporting structure 10 can be pivoted around a swivel pin 40 in known fashion by means of a piston/cylinder arrangement 41, this swivel pin and this position/cylinder arrangement also acting to deposit the reel. The piston/cylinder arrangement in this case can also carry out the task of applying or maintaining the contact pressure that may be required between the reel 25 and the backing roll 30. This movement is shown by double-headed arrow B. Furthermore, the same reference numbers as in the example embodiment as per FIGS. 1 to 3 are used in the example embodiment as per FIG. 4 for the parts having the same action.

Finally, in both example embodiments, a traversing carriage 42 is provided on which the whole supporting structure, together with the piston/cylinder arrangement 41, is carried and arranged so that they can move along stationary guides 44 with reference to the floor 43 in the direction of the backing roll axis in order, on the one hand, to make it possible for the clamping heads 15 to be drawn out of the winding tubes 16 of reel 25 (this is possible, of course, as a matter of principle even with a stationary carriage (42)) and, on the other hand, for reels of varying widths to be reeled. Finally, in the case of particularly small part-webs and several reeling devices on either side of the backing roll side, each reeling device can be moved as a whole parallel to the backing roll axis in order to create the space between adjacent reeling devices necessary to change reels. In extreme cases, the part-webs to be reeled of a reel-cutting machine can thus be as narrow as the width of the assemblies 44 (FIG. 3) of a reeling device arranged on both sides of the reel to be reeled.

We claim:

1. A reeling apparatus for reeling a traveling web, such as one of a plurality of longitudinally slit paper webs from an unwinding web reel the apparatus including a backing roll for supporting the traveling web, at least two movable, laterally spaced support arms disposed with one support arm near either side of the web, and for supporting a corresponding core chuck for engaging an end of a tube on which the web is to be reeled while nipped with the backing roll, the combination comprising:

carriage means mounted on each support arm for translational movement therealong, including a rotatably mounted drive shaft for rotatably supporting a core chuck;

traction means attached to the carriage means and movably mounted on at least one support arm for traveling along a path thereon, the traction means comprises a flexible loop and is mounted on a support arm about a plurality of rotatable rolls for defining its path of travel;

a traction drive motor mounted to at least one of the support arms for engaging the traction means to selectively move the carriage means on the support arms;

drive wheel means mounted in at least one of the carriage means and operatively engaged with the drive shaft for applying torque to the drive shaft;

tube drive means, including a looped belt means and a tube drive motor operatively associated with the belt means, mounted in the apparatus in association with at least one support arm and operatively associated with the drive wheel means for rotatably driving the drive shaft, and the tube and reel thereon, while the reel is nipped with the support roll.

2. A web reeling apparatus as set forth in claim 1, wherein:

the support arms are pivotally mounted such that they can be moved between a first position, where the carriage means can be in a position where the tube can be engaged in a nip with the backing roll, and a second position, where the carriage can be in a position where the wound reel can be deposited for removal from the apparatus.

3. A web reeling apparatus as set forth in claim 1, wherein:

the traction means through its connection with the carriage means comprises a flexible rope-like device mounted to the carriage for forming an endless loop with the carriage means;

the traction drive motor is mounted to a support arm;

each support arm includes a substantially straight guide, which guides are arrayed to be mutually parallel, and which are so constructed and arranged as to guide the carriage therealong as the diameter of the reel increases.

4. A web reeling apparatus as set forth in claim 1, wherein:

the tube drive means includes a roller means mounted to the carriage, and which is so constructed and arranged as to guide the belt means around the drive wheel and maintain driving engagement therewith regardless of the position of the carriage means on the support arms.

5. A web reeling apparatus as set forth in claim 1, wherein:

the traction means and the tube drive means are mounted to at least one of the support arms for independent movement relative to one another such that the torque applied to the winding tube by the tube drive means and the translational movement of the carriage on the support arms by the traction means can be independently effected.

6. A reeling apparatus for reeling a traveling web, such as one of a plurality of longitudinally slit paper webs from an unwinding web reel, the apparatus including a backing roll for supporting the traveling web, at least two movable, laterally spaced support arms disposed with one support arm near either side of the web, and for supporting a corresponding core chuck for engaging an end of a tube on which the web is to be reeled while nipped with the backing roll, the combination comprising:

the support arms are pivotally mounted co-axially, and each support arm includes a guide extending parallel with one another in the same plane;

carriage means, including a carriage having rollers for movably supporting the carriage means on the guides for translational movement on the support arms, the carriage including a rotatably mounted drive shaft for rotatably supporting a core chuck;

traction means, including an elongate, flexible rope-like device attached to the carriage to form a loop, the traction means movably mounted on at least one support arm for traveling along a path thereon;

a traction drive motor mounted to an arm for engaging the traction means to move the carriage means along the guides on the support arms;

drive wheel means mounted on the drive shaft, co-axially therewith, for applying torque to the drive shaft;

tube drive means, including a looped belt means and a tube drive motor operatively associated with the belt means, the tube drive motor mounted on at least one support arm and operatively associated with at least one of the drive wheel means for rotatably driving the drive shaft, and the tube and reel thereon, while the reel is nipped with the backing roll.

7. A web reeling apparatus as set forth in claim 6, further including:

piston means operatively linked with the support arms for pivoting the support arms between a first position, where the reel is nipped with the backing roll, and a second position, where the wound reel is positione for removal from the apparatus.

* * * * *